US006045464A

United States Patent [19]

Crist, Jr.

[11] Patent Number: 6,045,464

[45] Date of Patent: Apr. 4, 2000

[54] FOOTBALL SNAP SIMULATOR

[76] Inventor: Michael A. Crist, Jr., 1220 Monroe St., Quincy, Ill. 62301

[21] Appl. No.: 09/044,340

[22] Filed: Mar. 19, 1998

[51] Int. Cl.[7] ..... A63B 69/00

[52] U.S. Cl. ..... 473/438; 473/441

[58] Field of Search ..... 273/368; 473/438, 473/441, 445, FOR 124, 427

[56] References Cited

U.S. PATENT DOCUMENTS

| | | | |
|---|---|---|---|
| 831,069 | 9/1906 | Henrichsen | 273/368 |
| 2,602,666 | 7/1952 | Burke et al. | 473/443 |
| 3,011,786 | 12/1961 | Schmuck | 473/445 |
| 3,044,776 | 7/1962 | Weidmaier et al. | 473/441 |
| 3,062,547 | 11/1962 | Kopp | 473/441 |
| 3,674,265 | 7/1972 | Sheets et al. | 473/441 |
| 3,700,238 | 10/1972 | Mathis | 473/438 |
| 4,087,089 | 5/1978 | Forrest | 473/445 |
| 4,477,076 | 10/1984 | Monaco | 473/441 |
| 4,534,557 | 8/1985 | Bigelow et al. | 473/438 X |
| 5,275,396 | 1/1994 | Sudia | 473/427 |

FOREIGN PATENT DOCUMENTS

| | | | |
|---|---|---|---|
| 408711 | 9/1966 | Switzerland | 273/368 |
| 16158 | 3/1911 | United Kingdom | 273/368 |

*Primary Examiner*—John A. Ricci
*Attorney, Agent, or Firm*—Joseph W. Holloway

[57] ABSTRACT

A football training apparatus to develop the defensive reactions of football linemen, comprises a simulator to simulate the football being moved or snapped by the offensive center. The simulator includes a housing having at least one window. A motor having a rotary shaft is mounted in the housing. A panel having a drawing or representation of a football is mounted on the motor shaft for rotary movement therewith. A spring is connected between the panel and housing to normally bias the panel so that the simulated football is not visible through the window. A power supply is provided to rotate the motor shaft so that the simulated football becomes visible through the window and remains stationary, as an indication that the football has been snapped. A remote control may be provided, so that the power supply can be connected to the motor from a remote location, for operation by a coach or trainer who can observe the reaction of the linemen upon appearance of the simulated football.

17 Claims, 2 Drawing Sheets

FOOTBALL SNAP SIMULATOR

BACKGROUND OF THE INVENTION

This invention relates to training apparatus intended to develop the defensive reactions of football linemen. Such apparatus may comprise a football snap simulator controlled by a coach or other trainer-evaluator.

The most desirable training and practice conditions for defensive linemen entail the simulation of actual game conditions wherein the linemen first assume a set or down position and thereafter charge forwardly toward the offensive team in coordination with the football being moved or snapped by the offensive center. If any defensive lineman starts his charge prematurely in anticipation of the ball being snapped, his team could suffer an offside penalty which could critically effect the outcome of the game. On the other hand, should his reaction to the rush of the offensive lineman assigned to block him be overly cautious, he may be caught off balance and, therefore, be unable to counter his opponent's attack. In this regard, defensive linemen are at a decided disadvantage because the offensive linemen are mentally alert and physically primed to charge on a preset starting signal, whereas the defense must first visually perceive and subsequently react physically to movement of the opposition. Moreover, during the game, the offensive signal caller may intentionally vary the cadence and tonality of his audible countdown for the express purpose of drawing an unwary defensive lineman offside. An unsuccessful attempt by a defensive lineman to coordinate his charge with the offensive signal countdown can render him off balance thereby delaying his start or even causing him to jump offside.

Notwithstanding the aforenoted problems a defensive lineman may encounter in coordinating his charge with the audible signal calling of an opposing quarterback, it is not unusual for a coach or trainer himself to initiate starts during defensive practice drills by means of a similar audible signal. Under this circumstance, a lineman not only fails to develop a proper reflexive response to either the snap of the ball or the first movement of his opponent, but instead, is inappropriately trained to respond to sound rather than movement.

Recognizing that visual detection of starting movement by the opposing team is the preferred stimulus for triggering a lineman's defensive charge, others have developed various training devices which use this technic. Examples of such devices are disclosed in the following U.S. Patents:

U.S. Pat. No. 2,602,666 issued Jul. 08, 1952 to Burke etal

U.S. Pat. No. 3,011,786 issued Dec. 05, 1961 to Schmuck

U.S. Pat. No. 3,062,547 issued Nov. 06, 1962 to Kopp

U.S. Pat. No. 3,674,265 issued Jul. 04, 1972 to Sheets etal

U.S. Pat. No. 4,087,089 issued May. 02, 1978 to Forrest

U.S. Pat. No. 4,477,076 issued Sep. 16, 1984 to Monaco.

Each of the listed prior art devices includes a fairly massive framework having a relatively movable blocking pad or dummy which may be driven backward by the impact of a charging lineman.

The Schmuck device includes a visual signal in the form of a light in circuit with a switch which actuates the light in response to the starting movement of an offensive lineman Each of Burke, Kopp and Forrest has a padded bumper or dummy which may be selectively released from a latched or set position to simulate the start of an offensive lineman's charge.

Sheets discloses a blocking sled having a spring-driven plunger which forces a blocking pad forwardly and simultaneously operates a linkage for moving an attached ball object upwardly from the ground to simulate the snap of the ball by a center.

Monaco shows a defensive reaction blocking sled which includes one or more blocking dummies and a ball object positioned immediately below a central dummy. The ball is movable upwardly and rearwardly at the same time the dummy is moved from a set position forwardly and downwardly to a blocking position thereby to simulate the simultaneous snap of the football and a charge by an offensive lineman.

While each of the blocking devices shown in the aforedescribed U.S. Patents makes provision for a visually detectable start signal, these devices have remaining structural and operational shortcomings, namely:

1. Each is structurally integrated into a much more comprehensive apparatus primarily intended to develop a lineman's blocking technics and physical strength. Accordingly, such a starting device, be it an electric light, a padded dummy or a simulant ball object, comprises but a minor part of a typically massive and mechanically complex blocking apparatus. Because these starting devices are structurally integrated with other mechanisms of the parent blocking apparatus, they cannot be readily detached therefrom and are not capable of being used independently of the rest of the blocking apparatus as a free-standing starting device.

2. Kopp, Sheets, Forrest and Monaco show blocking sleds with starting devices which are tripped or otherwise physically operated by a coach or trainer who is positioned on the sled within easy reach of an operating handle or pedal for releasing a latch mechanism. The person operating the start device from a seat or platform on the sled is not favorably oriented to view a lineman's reaction to movement of the starting device; and, the intervening structural components of the sled may actually obscure the operating person's view.

The starting signal light of the Schmuck training apparatus is operated when an offensive lineman positioned opposite a defensive lineman raises his hand from ground level to deactivate an electric switch. The coach or trainer does not directly control the timing of the start signal but must, instead, utilize an additional person to whom a preliminary signal is given.

Burke employs a dummy attached to a trolley movable along an elevated beam of a superstructure fixed in the ground. Spring driven movement of the dummy provides a visual starting signal and such movement is actuated by an electric solenoid which releases a catch holding the trolley against the tension of the driving spring. The solenoid is energized by a manual switch in circuit with the solenoid and an electrical power supply; and, such switch may be operated by a coach at his discretion to release the trolley to simulate the charge of an opposer. Thereafter, the trolley must be manually retracted along its track to re-latch the same in preparation for the next defensive drill. While Burke provides a remotely controlled start mechanism of sorts, the range of movement of a coach is constrained by the use of an electrically conductive wire for connecting his manually operated switch to a solenoid which releases his start mechanism. Moreover, such a wire is depicted as trailing along the ground in and about the superstructure in potentially dangerous proximity to the area where players are practicing.

3. Excepting only the electric light device of Schmuck, all of the aforedescribed signaling devices require manual recocking or relatching between successive operations. In every case, the substantial mass of one or more blocking pads or dummies must be returned to it's home position either by moving the mass against the resistance of a spring or by lifting the entire mass. In either case, resetting such mechanisms can be physically exhausting and obviously introduces undesirable delays in drills where they are utilized in a repetitive fashion.

4. Since the visual signaling means incorporated in these massive devices are not free-standing and cannot be readily separated from their parent structures, none can be easily carried from place to place in a practice area. This lack of portability diminishes the desirability of such devices from the standpoints of storage and deployment as well as adaptability to a wide range of different practice routines.

5. Due to the mechanical complexity and attending high cost of manufacture of the aforenoted devices, the modest football programs of grade schools and small high schools may lack the necessary funds to purchase and thereafter maintain them.

SUMMARY OF THE INVENTION

A general object of this invention is to provide an improved football snap simulator which overcomes the enumerated shortcomings of the aforedescribed prior art devices intended for the same or similar purpose.

The principal objective of this invention is to provide a mechanical device which simulates snapping of a football and which displays the following advantageous characteristics:

1. The device can be used in a ground supported, free-standing mode; or, alternately, it can be detachably secured to some portion of a conventionally constructed practice sled of the type described above.

2. The device includes a simulant football object capable of automatic snapping movement when actuated by a wireless transmitter of the type employed with remotely controlled traveling toy vehicles and the like.

3. The controller employed for snapping the simulant football can be hand held and permits omnidirectional movement of the controller operator relative to the simulant device at a distance from the immediate area of play which allows visual evaluation of the starting rush of an individual lineman or of an entire defensive line.

4. The device is lightweight and structurally compact being only about twice the size of a conventional football. The box-like housing in which the operating mechanism of the device is disposed is provided with a convenient carrying handle which enables a single person to transport it from place to place with little effort; and, such enclosure is made of high-impact plastic which can withstand accidental impacting during practice drills. Certain walls of the enclosure comprise transparent panels or panes through which players aligned on either side of the device can view movement of the simulant football.

With the aforenoted objects and advantages in mind, a preferred embodiment of the invention includes a hand held transmitter remotely positioned with respect to a portable housing which encloses the following structural and operating components:

a) a receiver for signals emanating from the transmitter;

b) a rotary D.C. electric motor;

c) a D.C. power supply for the receiver and the motor;

d) a receiver-actuated control circuit for selectively connecting the motor and the power supply;

e) an output shaft for the motor having opposed projecting ends terminating proximate transparent walls of said housing;

f) a pair of thin panels fashioned to simulate a football and each having a hub portion attached to one end or the other of the motor output shaft for arcuate movement therewith; and, g) an extension coil spring having one end connected to a panel and the other end anchored to the base of the housing whereby arcuate motion of the panels is constrained and then automatically reversed to an initial home position when power to the motor is interrupted.

Another specific object is the provision of a windowed frontal wall for the housing through which auxiliary indicators attached to the simulant football panels are readily visible to a defensive linemen positioned in frontal alignment with the snap simulator.

A more specific objective is provision of means carried exteriorly on the housing for detachably mounting the football snap simulator to a member of a blocking sled or like training device.

Yet another advantage is realized by the utilization of tough yet inexpensive plastic material for the entire housing and for most of the operating components of this invention. By this means, the snap simulator is made rugged and durable in use and its initial cost of manufacture is low due to the fact that most of its parts can be mass produced by conventional molding methods.

These and other advantages and objects of this invention and the manner of obtaining them will become apparent and the invention will be best appreciated and fully understood by having reference to the following detailed description of the invention taken in conjunction with the accompanying drawings.

DETAILED DESCRIPTION OF THE INVENTION

Figure 1:
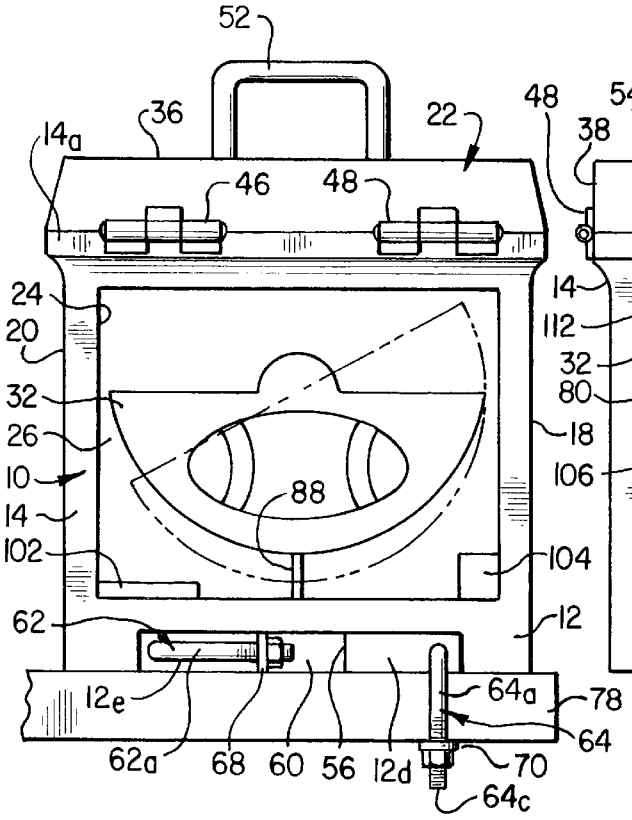
FIG. 1 is a side elevation showing a football snap simulator constructed in accordance with this invention and attached to a protruding member of a blocking sled.
Figure 2:
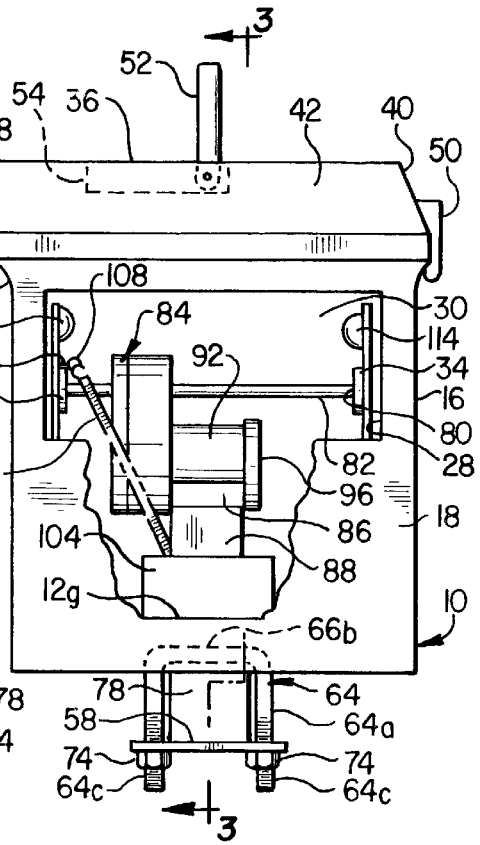
FIG. 2 is a frontal view of the simulator shown in FIG. 1 with a portion of its housing broken away.
Figure 5:
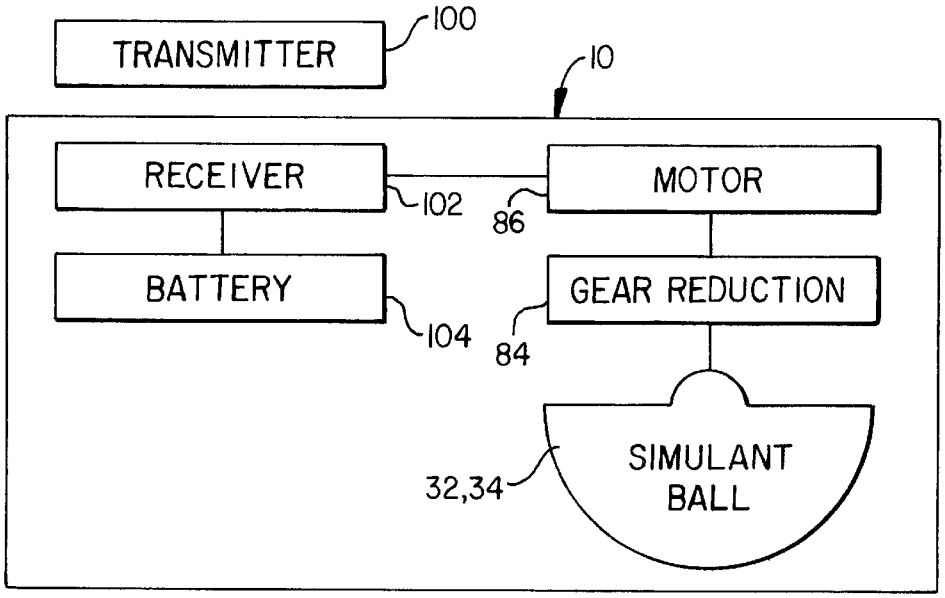
Figure 3:
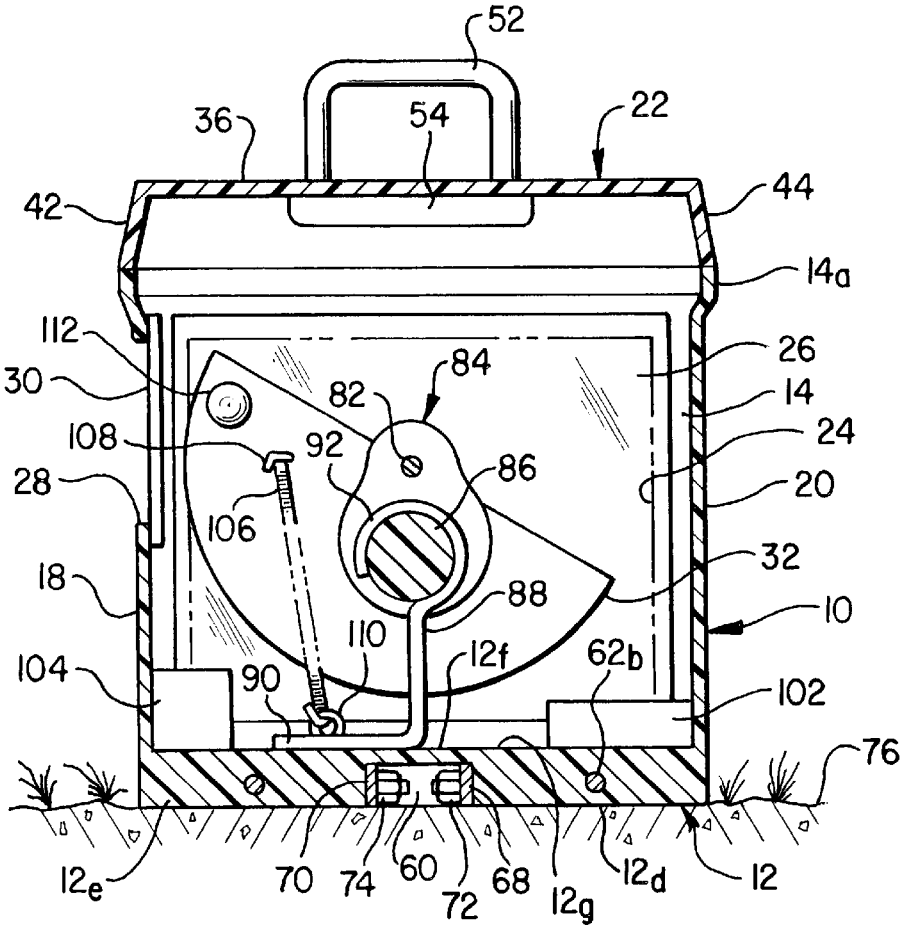
FIG. 3 is a sectional view taken substantially along lines 3—3 of FIG. 2.

Referring to FIGS. 1 through 4 of the drawings, a box-like housing, indicated in its entirety by numeral 10, generally comprises a base 12; two side walls 14 and 16 and two end walls 18 and 20 extending upward from base 10; and, a hinged lid 22 overlying the open housing top which is defined by the upper edges of the vertical walls. The side wall 14 has a window 24 therethrough covered by a panel or pane 26 of transparent plastic material which is secured to the interior surface of side wall 14 by adhesive or other suitable means. A second window through side wall 16 is not shown but is identical to window 24 and is likewise covered by a pane. A third window 28 through end wall 18 is closed by a pane 30. The corresponding windows in sidewalls 14, 16 are shaped and sized to afford maximum lateral visibility for each of two football simulant panels 32 and 34 operably supported inside housing 10 in close lateral proximity with the transparent panes attached to sidewalls 14, 16. As best seen in FIGS. 2 and 3 and for a reason to be explained later, the window 28 in the front end wall 18 is made substantially shorter in vertical height than the window in sidewall 14, for example.

The aforementioned closure lid 22 resembles an inverted, dish having a flat top 36 and depending walls 38, 40, 42 and 44. The upright lid wall 38 and a corresponding upper portion 14*a* of the sidewall 14 have a pair of axially aligned and horizontally spaced pin hinges 46, 48 attached thereto by conventional means. A suitable two-part hasp 50 is located opposite hinges 46, 48 and is digitally operable to secure the lid 22 in a closed condition wherein the lower perimeter of lid 22 is clamped against the upper perimeter of the walls of housing 10. As best illustrated in FIGS. 2 and 3, a C-shaped carrying handle 52 is pivotally attached to the top wall 36 of lid 22. When not in use, the handle 52 may be pivoted about the ends of its arms 52*a* and 52*b* toward wall 38 of the lid 22 for conveniently storing the handle in a suitably shaped cavity 54 which opens to the top surface of the lid.

Figure 4:
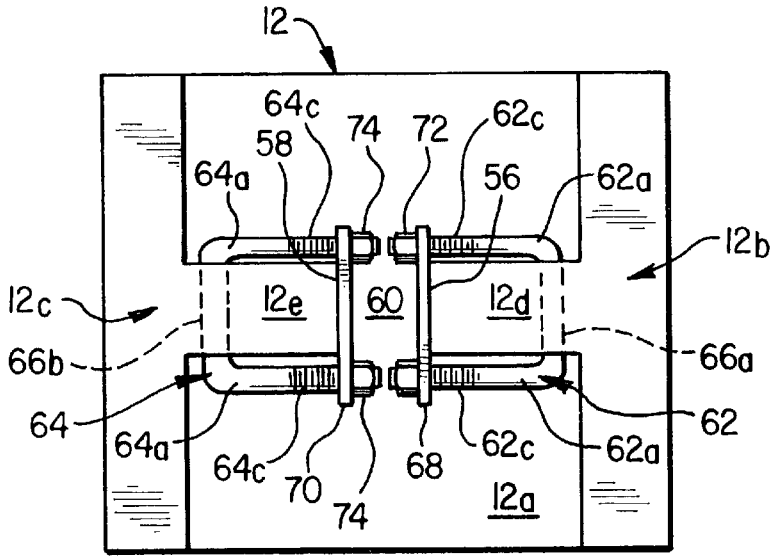
FIG. 4 is a bottom plan view showing how the mounting brackets for the simulator are stored on the housing; and, FIG. 5 is a block diagram.

FIG. 4 shows that the base 12 of housing 10 includes oppositely extending, T-shaped pads 12*b* and 12*c*, which project outwardly from the exterior bottom surface 12*a* of the base. As best shown in FIG. 3, the converging legs 12*d* and 12*e* of the pads 12*b*, 12*c* terminate in confronting vertical surfaces 56, 58 which, in part, define a transverse notch 60 between the legs. An interconnecting web 12*f* located between notch surface 56, 58 comprises a portion of the housing's inner surface 12*g*.

To produce a snap simulating device which is lightweight, therefore highly portable, most of the components of the housing 10 are fabricated by molding base 12, side walls 14, 16, 18 and 20 and lid 22 of any tough and durable plastic material. The lid may be attached to the sidewall 14 by an integrally molded hinge in place of hinges 46 and 48; and, the hasp 50 and the handle 52 may be attached to the lid 22 by interconnecting molded sections which flex to permit movement of the hasp and handle relative to the lid.

FIG. 4 illustrates U-shaped clevis bolts 62, 64 each having laterally spaced pairs of legs, 62*a* and 64*a* respectively, which are joined by cross members 62*b* and 64*b* and which have threads 62*c* and 64*c* formed at the free ends thereof. The cross members 62*b* and 64*b* are received in bores 66*a* and 66*b* extending through the legs 12*d* and 12*e* of pads 12*b*, and 12*c* respectively. A pair of rectangular plates 68, 70 are apertured proximate their opposite ends to receive therethrough the threaded end segments of clevis legs 62*a*, 64*a*, respectively. In their stored condition the clevis legs 62*a* and 64*a* straddle the legs 12*d* and 12*e* of the pads 12*b* and 12*c* and are generally parallel with the bottom of housing 12 as best shown by viewing clevis leg 62*a* in FIG. 1. Legs 62*a* and 64*a* are held in the stored condition illustrated in FIG. 4 by the compressive engagement of the plates 68, 70 with the pad surfaces 56, 58; and, nuts 72 and 74 are selectively tightened on the threaded clevis ends 62*c*, 64*c* to produce the necessary compressive engagement.

One important advantage provided by this invention is that the T-shaped pads 12*b*, 12*c* of housing 10 may be directly supported by an underlying practice surface such as the turf shown at numeral 76 in FIG. 3; or, alternatively, the housing 10 can be clamped to a suitable projecting structural member At 78 of a conventional blocking sled, not shown. FIG. 4 shows both clevises 62 and 64 in their stored condition; FIG. 1 shows only clevis 62 in its stored condition; and, FIGS. 1 and 2 shown clevis 64 in clamping engagement about the beam 78.

The aforementioned cutouts 32 and 34 are shaped and painted to simulate the side view of a full sized football. Preferably these simulants are lightweight and are fabricated from a thin yet durable laminate panel. Hubs 80 are suitably attached to the inward facing surfaces of cutouts 32 and 34; and, the hubs 80, in turn are fixed to and driven by the opposite ends of the rotary output shaft 82 of a speed reduction gear box 84. A lightweight D.C. electric motor 86 is supported in spaced relation with the housing base 12, the housing walls 14, 16 18 and 20, and the lid 22 by an upright bracket 88 having a bent foot 90 suitably attached to base 12 and having an arcuate upper portion 92 which encircles a major portion of the cylindrical housing of motor 86. As best illustrated in FIGS. 2 and 3, the motor housing is connected at one end to the lower portion of the housing 88 of gear box 84 and terminates at the other end in an enlarged boss or end cap 96. The curved upper portion 92 of bracket 88 is capable of clamping the motor 86 against rotation; and, the width of the curved upper portion 92 is selected to interfit closely between the gear box housing 88 and the motor end cap 96 to prevent longitudinal displacement of the motor 86.

The structure, materials, and operation of motor 86 and gear box 84 are conventional and commercially available; therefore, no further description of these items is required for an understanding of the present invention. Likewise, the electrical and electronic components of this invention are individually well known, each having been previously used in one form or another to power and remotely control various toys and hobby devices such as, surface vehicles, boats, airplanes and the likes Included in the general makeup of the snap simulator according to this invention are a signal transmitter 100, a signal receiver 102, and a D.C. power supply comprising a battery 104, the aforedescribed motor 86, the gear type speed reducer 84 and the simulant balls 32, 34. The battery operated transmitter 100, which is small and easily held in the coach's hand, is digitally opted to transmit a signal of the radio or ultra violet type which is detected by the receiver whereupon control circuitry associated with the receiver 102 and battery 104 produces a pulse of direct current which is carried by appropriate wiring, not shown, to the D.C. motor 86 which then rotates the reduction gearing 84, the output shaft 82 and the simulant balls 32, 34. The battery, which may be of the rechargeable type, is preferably small and lightweight and has an output power of 7.5 V D.C. which matches the input power requirements of the receiver 102 and the motor 86. The receiver 102 and the battery 104 are suitably situated and retained on the housing's bottom interior surface 12*g* by any preferred means.

As best illustrated in FIGS. 2 and 3, a coiled extension spring 106 has its upper end connected to the interior side surface of panel 32 by any suitable means such as eye-bolt 108; and, the lower end of spring 106 is anchored to the foot 90 of bracket 88 by another eye-bolt 110 or the like. When the motor 86 is actuated, spring 106 will be elongated as the panel 32 rotates or snaps counterclockwise as shown in FIG. 1 from the depicted full line position to the moved position shown in phantom lines. When the control circuitry associated with receiver 102 disconnects the battery 104 from motor 86, the resiliency of spring 106 will reset or cock the panel 32 in the full line or home position shown in FIG. 1. The length of the pulse of operating current supplied by the receiver 102 to the motor 86, the shaft speed of motor 86, and the torque increase provided by the gear box 84 should be selected so that the resistance to stretching of spring 106 will arrest further rotation of the panels 32 and 34 beyond the extreme angular position shown in full lines in FIGS. 2 and 3. If needed to limit and reverse the arcuate movement of the panels 32 and 34 in the manner described above, a second resilient means corresponding to spring 106 may be attached between the interior surface of panel 34 and eye-bolt 110.

OPERATION OF THE INVENTION

If the housing 10 is to be mounted upon a blocking sled, or the like, a suitable sled member, such as beam 78, is selected to have clamped thereabout the clevises 62, 64. Preferably, the selected beam extends longitudinally from the sled and is vertically spaced somewhat above ground level but no higher than eye level with respect to linemen situated in a set or down position proximate the sled. If the sled has no structural member suitable for direct attachment of housing 10 thereto, the housing may be free standing, i.e. seated directly on the ground surface 76, as shown in FIG. 3. Alternately, a suitably fashioned bracket, not shown, may be employed to connect the housing rigidly to the sled framework.

To deploy the devises 62, 64 from their stored condition shown in FIG. 4, the nuts 72, 74 are loosened sufficiently to relieve the compression of plates 68 and 70 against the vertical surfaces 56 and 58 of notch 60. Thereafter, both devises are rotated to the vertically depending position; and, the housing is disposed on the sled so that beam 78 fully penetrates both devises with the frontal window pane 30 being visible from a position in front of the free end of beam 78, as viewed in FIG. 2. With housing 10 clamped upon beam 78, the three transparent window panes afford lateral visibility of the simulant balls 32, 34 through the left and right housing walls 14, 16, respectively, and visibility of the forward edges of both simulant balls through the front wall 18. Whether the housing 10 is affixed to a sled as described above or placed on the ground surface 76, as shown in FIG. 3, players lined up laterally of the housing 10 and those confronting the housing can readily perceive and respond to the initial movement of the snap simulating balls 32, 34. Auxilliary snap indicators 112, 114, which may comprise projecting halves of a colored ball best seen in FIGS. 2 and 3, are suitably attached to inward facing surfaces of the cutout ball panels 32, 34. Such projections 112, 114 are placed on the panels 32, 34 to afford visibility through window 28 for a player or players positioned frontally of the housing 10.

If the snap simulator described herein is to be used in a free standing manner, the devises 62, 64 remain in their stored condition, shown in FIG. 4, and the base 12 of housing 10 is seated directly upon surface 76 of a practice area. Due to the light weight and compactness of the entire simulator, it may be carried from place to place with little effort by means of the storable handle 52. Whether the selected practice area comprises a hard, flat surface, such as concrete or a wooden gymnasium floor, or natural or artificial turf, the vertical stability of the housing with respect, to an underlying surface is maintained by means of the T-shaped pads 12*b*, 12*c* forming the extreme bottom surface of the housing base 12.

Once the simulator housing 10 is either removably attached to a sled or is positioned directly on a supporting practice surface, a number of linemen may take set positions at either or both sides of the housing or in front of the housing as required by a selected response training exercise. The transmitter 100 is then remotely operated by a coach or a trainer to create a signal which is received and suitably processed by the receiver 102 to cause the motor 86 and gear reduction mechanism 84 to rotate the shaft 82. Preferably, the effective range of the transmitter 100 is such that an operator located a considerable distance from the snap simulator may view and evaluate the charge of individual linemen as well as the unit response of an entire defensive line.

In response to momentary actuation of motor 86, shaft 82 imparts a quick movement to the simulant balls 32, 34 and their respective auxiliary indicators 112, 114. Linemen will observe that the balls appear to snap arcuately as shown in FIGS. 1 and 2 from the full line home position to a shifted phantom line position. Such arcuate movement of ball 32 also produces elongation of the coil spring 106 followed by rapid action of the coil spring which automatically reverses shaft 82 and restores both balls to their full line home positions shown in FIG. 1. Such automatic resetting provides substantial savings of time and effort over that required to reset the aforedescribed prior art devices.

It should be recognized that the football snap simulator of this invention fully achieves the broad objective of providing a flexible, cost-effective and easy to use training device for improving the reaction timing of defensive linemen. Moreover the simulator can be retrofitted into an existing, more comprehensive training apparatus or used as a single purpose, free-standing device. Furthermore, it will be understood by those skilled in the art that the foregoing description sets forth a preferred and enabling embodiment of the invention which can be changed or modified in size, construction and materials without departing from the scope of the invention as set forth in the following claims. For example, the shaft 82 could be coupled to and operably rotated by a servo device responsive to a remote controller. Also the motor 86 could be reversible whereby the resetting spring could be eliminated.

I claim as my invention:

1. A simulator, including:

a) rotary driving means including a motor;

b) remotely controlled signalling means for actuating said motor;

c) said signalling means including a receiver for signals emanating from a remote transmitter;

d) a simulant ball object coupled to said motor for arcuate movement thereby; and, e) said simulant ball object comprising a simulant football.

2. The invention set forth in claim 1, together with:

a hollow housing having disposed therein said driving means, said remotely controlled signaling means, and said ball object.

3. The invention set forth in claim 2, wherein:

a) said housing includes a base and upstanding walls connected to said base; and, b) at least one of said walls comprises a transparent means through which said ball object is visible from outside said housing.

4. The invention set forth in claim 3, wherein:

a) said driving means is supported in spaced relation to said upstanding walls by bracket means extending from said housing base;

b) said simulant football is drivingly coupled to said driving means by an intermediate rotary shaft.

5. The invention set forth in claim 4, wherein:

a) said shaft extends laterally from said driving means toward said transparent portion; and, b) said simulant football is supported by said shaft in close proximity to said transparent portion.

6. The invention set forth in claim 3, wherein:

said walls include opposed side walls and a frontal wall connecting said side walls; and, each of said walls has a transparent portion comprising an opening therethrough overlain by a pane of transparent material.

7. The invention set forth in claim 6, together with:

a) support means for holding said'simulant ball object above said base in substantial vertical alignment with all of said transparent portions.

8. The invention set forth in claim 6, wherein:

said ball object has attached thereto a projecting object which is visible from outside said housing through said frontal wall.

9. The invention set forth in claim 3, wherein:

said base includes a bottom surface for supporting said housing on an underlying surface.

10. The invention set forth in claim 3, wherein:

said housing includes holding means for selectively attaching and detaching the same to a separate apparatus for supporting said housing above an underlying surface.

11. The invention set forth in claim 10, wherein:

said holding means comprise clevis means for connecting said base of said housing to said separate apparatus.

12. The invention set forth in claim 10, wherein:

said holding means is attached to said base and is stored thereon when detached from said separate apparatus.

13. The invention set forth in claim 3, wherein:

said housing means includes a lid pivotable about one of said walls; and, such lid is provided with a handle.

14. The invention set forth in claim 1, wherein:

a) said simulant football comprises a cutout portion of a relatively thin panel; and, b) in lateral prospect, said cutout portion is approximately the size and shape of a standard football.

15. The invention set forth in claim 1, wherein:

a) said driving means includes a speed reducing means driven by said motor and coupled to said simulant football.

16. A simulator, including:

a) rotary driving means;

b) remotely controlled signalling means for actuating said driving means;

c) a simulant ball object coupled to said driving means which acts to move said ball object arcuately in one direction; and, d) biasing means coupled with said ball object to reverse the arcuate movement of said ball object produced by said driving means.

17. The invention set forth in claim 16, wherein:

said biasing means comprises a stretchable coil spring attached to said housing and to said ball object.

* * * * *